US010648085B2

(12) United States Patent
Reznik et al.

(10) Patent No.: US 10,648,085 B2
(45) Date of Patent: May 12, 2020

(54) COLD GAS DYNAMIC SPRAYING USING A MASK

(71) Applicant: Siemens Aktiengesellschaft, Munich (DE)

(72) Inventors: Daniel Reznik, Berlin (DE); Oliver Stier, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 47 days.

(21) Appl. No.: 15/546,440

(22) PCT Filed: Jan. 13, 2016

(86) PCT No.: PCT/EP2016/050533
§ 371 (c)(1),
(2) Date: Jul. 26, 2017

(87) PCT Pub. No.: WO2016/124362
PCT Pub. Date: Aug. 11, 2016

(65) Prior Publication Data

US 2018/0274104 A1 Sep. 27, 2018

(30) Foreign Application Priority Data

Feb. 4, 2015 (DE) ..... 10 2015 201 927

(51) Int. Cl.
*C23C 24/04* (2006.01)

(52) U.S. Cl.
CPC ..... *C23C 24/04* (2013.01)

(58) Field of Classification Search
CPC ..... C23C 14/042; B29C 33/301–303
See application file for complete search history.

(56) References Cited

U.S. PATENT DOCUMENTS 5,203,944 A 4/1993 Prinz et al. ..... 156/247
6,193,922 B1 * 2/2001 Ederer ..... B29C 64/40 264/401

(Continued)

FOREIGN PATENT DOCUMENTS

CN 1647258 A 7/2005 ..... B81C 1/00
DE 102004058806 A1 6/2006 ..... H01L 23/36

(Continued)

OTHER PUBLICATIONS

Japanese Office Action, Application No. 2017541690, 7 pages, dated Sep. 3, 2018.

(Continued)

*Primary Examiner* — Alex A Rolland
(74) *Attorney, Agent, or Firm* — Slayden Grubert Beard PLLC

(57) ABSTRACT

The present disclosure relates to coating a carrier component by means of cold gas dynamic spraying. For example, a method for coating a carrier component may include: laying a mask with an opening on the component; depositing a material through the opening to completely fill up the mask opening; removing any material located above the upper side to form a flat surface even with the upper side of the mask; laying a second mask on the first mask; depositing the material again; removing any deposited material located above the upper side of the second mask to form a flat surface even with the upper side of the second mask; repeating layers of additional masks and material deposition until the deposited material reaches a required thickness on the carrier component; and after completion of the coating to the required thickness, removing the masks.

11 Claims, 3 Drawing Sheets

(56) References Cited

U.S. PATENT DOCUMENTS

| | | | | |
|---|---|---|---|---|
| 6,251,488 | B1 | 6/2001 | Miller et al. | 427/596 |
| 6,291,012 | B1 | 9/2001 | Miyasaka | 427/191 |
| 2003/0219576 | A1 | 11/2003 | Elmoursi et al. | 428/210 |
| 2004/0000489 | A1 | 1/2004 | Zhang et al. | 205/118 |
| 2005/0194348 | A1 | 9/2005 | Cohen et al. | 216/12 |
| 2005/0233503 | A1 | 10/2005 | Leib et al. | 438/127 |
| 2006/0108601 | A1 | 5/2006 | Okamoto | 257/177 |
| 2006/0258055 | A1 | 11/2006 | Okamoto | 438/124 |
| 2007/0154641 | A1 | 7/2007 | Kobayashi et al. | 427/282 |
| 2009/0202732 | A1 | 8/2009 | Krüger et al. | 427/427 |
| 2010/0230086 | A1 | 9/2010 | Tsuzuki et al. | 165/185 |
| 2011/0223325 | A1 | 9/2011 | Jakimov et al. | 427/197 |
| 2012/0181685 | A1 | 7/2012 | Ohno | 257/734 |
| 2012/0228776 | A1* | 9/2012 | Ohno | C23C 24/04 257/773 |
| 2014/0120195 | A1* | 5/2014 | Ploskonka | B29C 33/301 425/174 |
| 2014/0272121 | A1* | 9/2014 | Ng | B29C 33/3842 427/133 |
| 2014/0322501 | A1 | 10/2014 | Ederer et al. | 428/206 |
| 2014/0356219 | A1 | 12/2014 | Gammel et al. | 419/66 |

FOREIGN PATENT DOCUMENTS

| | | | | |
|---|---|---|---|---|
| EP | 0860516 | A2 | 8/1998 | C23C 24/04 |
| JP | 05503249 | A | 6/1993 | B05D 1/08 |
| JP | 10195676 | A | 7/1998 | B22D 23/00 |
| JP | 10280165 | A | 10/1998 | C23C 24/04 |
| JP | 2002544387 | A | 12/2002 | B23K 26/34 |
| JP | 2004508941 | A | 3/2004 | B05D 1/26 |
| JP | 2005524775 | A | 8/2005 | C25D 21/12 |
| JP | 2005532015 | A | 10/2005 | B81B 3/00 |
| JP | 2006179856 | A | 7/2006 | H01L 23/14 |
| JP | 2006319146 | A | 11/2006 | H01L 23/12 |
| JP | 2008124158 | A | 5/2008 | H01L 23/12 |
| JP | 2008544092 | A | 12/2008 | C04B 35/64 |
| JP | 2009127086 | A | 6/2009 | C23C 24/04 |
| WO | 2016/124362 | A1 | 8/1916 | C23C 24/04 |
| WO | 98/46415 | A1 | 10/1998 | B23C 67/00 |
| WO | 2011/145202 | A1 | 11/2011 | C23C 24/04 |

OTHER PUBLICATIONS

Weiss, L.E. et al., "Thermal Spray Shape Deposition," Journal of Thermal Spray Technology, vol. 1, No. 3, pp. 231-237, Sep. 1992.

Ernst, K.R. et al., "Diversity of Applications for Cold Spraying," Tagungsband der Gemeinschaft Thermisches Spritzen e.V., Conference Proceedings, pp. 159-170 (14 pages), Nov. 8, 2012.

Kim, Do-Yeon et al., "Cold Spray Deposition of Copper Electrodes on Silicon and Glass Substrates," Journal of Spray Technology, vol. 22, No. 7, pp. 1092-1102, Jun. 11, 2013.

German Office Action, Application No. 102015201927.6, 9 pages, dated Oct. 12, 2015.

International Search Report and Written Opinion, Application No. PCT/EP2016/050533, 16 pages, dated Mar. 24, 2016.

Japanese Grant Decision, Application No. 2017541690, 3 pages, dated May 8, 2019.

Japanese Decision to Grant, Application No. 2017541690, 3 pages, dated May 8, 2019.

Chinese Office Action, Application No. 201680008416.5, 5 pages, dated Sep. 3, 2019.

* cited by examiner

COLD GAS DYNAMIC SPRAYING USING A MASK

CROSS-REFERENCE TO RELATED APPLICATIONS

This application is a U.S. National Stage Application of International Application No. PCT/EP2016/050533 filed Jan. 13, 2016, which designates the United States of America, and claims priority to DE Application No. 10 2015 201 927.6 filed Feb. 4, 2015, the contents of which are hereby incorporated by reference in their entirety.

TECHNICAL FIELD

The present disclosure relates to coating a carrier component by means of cold gas dynamic spraying. The teachings may be embodied in methods or systems for the same.

BACKGROUND

In typical cold gas dynamic spraying, particles for the coating are accelerated to supersonic speed by means of a convergent-divergent nozzle so that they, on account of their impressed kinetic energy, remain adhered to the surface which is to be coated. In this case, the kinetic energy of the particles leads to a plastic deformation, wherein the coating particles upon impact are fused only on their surface. In comparison to other thermal spraying methods, it is referred to as cold gas dynamic spraying because it is carried out at comparatively low temperatures at which the coating particles in the main remain solid. Cold gas dynamic spraying, also referred to as kinetic spraying, includes a cold gas spraying plant with a gas heating device for heating a gas. Connected to the gas heating device is a stagnation chamber which on the outlet side is connected to a convergent-divergent nozzle, e.g., a Laval nozzle. Convergent-divergent nozzles have a converging section and also a diverging section which are connected by means of a nozzle neck. The convergent-divergent nozzle creates on the outlet side a powder jet in the form of a gas flow, with particles located therein, at high speed, preferably at supersonic speed.

According to DE 10 2004 058 806 A1, for example, at least one structured, electrically insulating layer and a structured, electrically conducting layer can be formed on a cooling body. In this method, masks include openings which correspond to the structuring. The structured layers serve as circuit structures which satisfy electrical requirements such as a specified conductor cross section. The layers can lie one on top of the other in a plurality of layer planes.

D.-Y. Kim et al., "Cold Spray Deposition of Copper Electrodes on Silicon and Glass Substrates", Journal of Thermal Spray Technology, Vol. 22, October 2013, teaches that the production of printed conductors by means of cold gas dynamic spraying with the aid of masks that lie upon the substrate nevertheless poses the problem that the masks which are required for this have openings of small width. The ratio between the width of the mask openings and the mask thickness leads in this case to flow conditions of the cold gas jet in the mask opening which makes deposition of the particles difficult. Specifically, a back flow may lead to a triangular cross section of the deposited material forming on the mask walls, wherein the point of this cross section lies in the middle of the mask opening and faces the cold gas jet. No material remains adhered to the walls to the mask opening itself. It is essential for the production of printed conductors that the cross section of the printed conductor is suitable for the transmission of the required electric current—the generated cross-sectional shape being of minor importance in comparison to this.

To avoid the flow conditions which are unfavorable for the deposition of rectangular cross sections, according to K.-R. Ernst et al., "Application Diversity of Cold Gas Spraying", Conference Proceedings of the Thermal Spraying Community e.V., Press: Gerdfried Wolferstetter, Gilching 2012, it is proposed that the mask does not have to be laid upon the carrier component for cold gas spraying but this can be fixed at a certain distance from the carrier component. This measure, however, has the effect that with increasing mask distance from the carrier component the flanks of the sprayed surfaces extend beyond the dimensions of the mask opening. The cross section of the structures which are produced in the mask openings is therefore not rectangular either but approximately trapezoidal.

SUMMARY

The teachings of the present disclosure may improve methods for cold gas dynamic spraying and provide a coating effect in which the geometry of the flanks can be produced with comparatively high accuracy. For example, in some embodiments, a mask is laid upon the carrier component before coating and in the region of an opening of this mask a material is deposited upon the carrier component, wherein the material completely fills up the mask opening.

Some embodiments may include methods for coating a carrier component (11) by means of cold gas dynamic spraying, in which a mask (12) is laid upon the carrier component (11) before the coating and in the region of an opening (13) of this mask (12) a material (14) is deposited on the carrier component (11), wherein the material (14) completely fills up the mask opening (13). In one method step, after deposition of the material (14), a removal process is carried out, in which the deposited material (14), which is located above the level of the upper side of the mask (12), is removed and a flat surface is formed in the region of the mask opening (13) and on the mask (12). In a further method step an additional mask (12*a*, 12*b*, 12*c*, 12*d*) is laid upon the upper side of the mask and in the region of an opening (13) of this additional mask (12*a*, 12*b*, 12*c*, 12*d*) a material (14) is deposited upon the already deposited material (14). The two aforesaid method steps are carried out until the deposited material (14) has achieved the required thickness on the carrier component (11) and, after completion of the coating, the masks are removed.

In some embodiments, the coating effect which is formed from the deposited material (14) is separated from the carrier component (11).

In some embodiments, at least some of the masks (12, 12*a*, 12*b*, 12*c*, 12*d*) have a thickness of at most 1 mm.

In some embodiments, all the masks (12, 12*a*, 12*b*, 12*c*, 12*d*), the openings (13) of which have widths of at most 1 mm at least in one direction, have a thickness of at most 1 mm.

In some embodiments, in the case of all the masks (12, 12*a*, 12*b*, 12*c*, 12*d*), a ratio of at most 1 is maintained between thickness of the mask and smallest width of the mask opening (13).

In some embodiments, consecutive masks (12, 12*a*, 12*b*) have congruent openings (13) or openings (13) which lie completely one on top of the other and reduce in size.

In some embodiments, at least one mask (12*f*) is constructed in a multiplicity of parts, wherein parting lines (24)

extend from the outer edge of the mask to the mask openings in such a way that the mask parts (23) can be pulled apart parallel to their upper side.

In some embodiments, at least one of the masks (12, 12*a*, 12*b*, 12*c*, 12*d*) is filled up in a plurality of steps, wherein after the respective steps of depositing the material (14) a removal process is carried out, in which the deposited material (14), which is located above the level of the upper side of the mask, is removed.

In some embodiments, the permissible thickness of at least one of the masks (12, 12*a*, 12*b*, 12*c*, 12*d*) is determined by the mask being completely filled up with the material (14) which is to be machined and by the coating effect which is formed from the deposited material (14) being subsequently tested as to whether a required quality is achieved.

In some embodiments, the determined, suitable thickness of the masks (12, 12*a*, 12*b*, 12*c*, 12*d*) together with the method parameters of the coating are stored in a data bank.

In some embodiments, the design of the mask openings (13), taking into consideration the mask thickness for a component, is determined by the geometry of the component (21) being broken down by computer calculation into disks lying one on top of the other, which determine the volume of the mask openings (13).

BRIEF DESCRIPTION OF THE DRAWINGS

Further details of the disclosure are described below with reference to the drawings. The same or corresponding drawing elements are provided in each case with the same designations and are explained in later Figures only in so far as differences arise between the individual figures. In the drawings.

DETAILED DESCRIPTION

Figure 1:
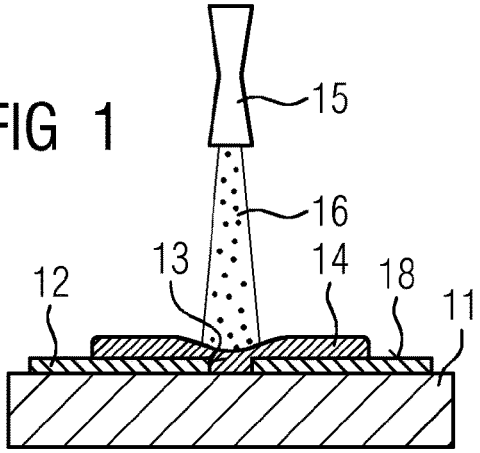
FIGS. 1 to 7 show in a schematically sectioned view selected method steps of an exemplary embodiment of the method according to teachings of the present disclosure for creating a columnar structure.

In some embodiments, methods include a removal process carried out in a step after deposition of the material (which as a result is located in the mask opening and has possibly also been deposited on the edges of the mask opening), in which process the deposited material, which is located above the level of the upper side (facing the cold gas jet) of the mask, is removed. In a further method step, an additional mask is laid according upon the upper side of the mask and in the region of an opening of this mask a material is deposited upon the already deposited material (this material can have the same composition as the previously applied material or may differ in its composition). By removing the material in the preceding method step, the additional mask can lie upon the hereby leveled surface of the preceding mask. Also, a flat surface is created in the region of the mask opening and lies exactly in the plane of the surface of the already filled up mask.

Therefore, the additional applied mask can also be completely filled up again with the material.

The two last-named method steps can be carried out until the deposited material has achieved the structurally predetermined thickness on the carrier component. With this, the coating is completed and the masks can be removed, wherein the coating effect remains behind on the carrier component. One potential advantage in the use of a plurality of masks lies in the fact that regardless of the thickness of the coating effect the thickness of the masks can merely be designed from points of view of a flow-dynamically favorable filling by the material.

In some embodiments, a plurality of masks are laid one on top of the other in order to produce the necessary thickness of the coating effect. Each of the masks is filled up individually during this, wherein the total filling up is ensued by the choice of the mask thickness. As a result of the subsequent removal of the surplus material, it is furthermore ensured that the adjacent masks lie sufficiently tightly against each other so that an uninterrupted forming of the corresponding section of the coating structure can ensue. As a result of the total filling up of the respective masks, flanks of the generated coating layers, which butt directly against the walls of the mask openings, may be developed.

As a result of this, structures, the lateral limits of which extend strictly perpendicularly to the surface of the carrier component, can be produced by means of cold gas dynamic spraying. In particular, columnar structures can be produced in this way if the openings of adjacent masks lie completely one on top of the other.

In general, the openings of adjacent masks overlap at least in sections so that the coating effect is formed in one piece. Naturally, a plurality of such coating effects, which are not mutually in contact, can be created on the carrier component. If the consecutive masks have congruent openings or openings which lie one on top of the other and reduce in size, the advantage additionally arises that after termination of the coating the masks can be removed from the component in a particularly simple manner. These can then be lifted in the upward direction (that is to say perpendicularly away from the carrier component) in a simple manner since no undercuts have been formed in the coating effects which have been produced.

In some embodiments, the coating effect formed on the material is separated from the carrier component. The coating effect therefore constitutes a component itself which after separation from the carrier component can be transferred to its intended use. In such embodiments, the carrier component itself serves as a building platform for the coating effect.

The methods may be used as a generative production process for components. For preparation of such a process, the design of the mask openings, taking into consideration the mask thickness for a component, is determined by the geometry of this component being broken down by computer calculation into disks which lie one on top of the other.

The calculation methods which are customary for this are generally known and may be based on CAD models of the components which are to be produced. The calculated disks of the component provide the volume of the mask openings in said embodiment of the method. When determining the thickness of the disks, consideration is therefore to be given to which thickness the masks are to have.

In some embodiments, the method may be used in order to provide a component with a structured coating. This component, which for example can be used in a machine, constitutes the carrier component. The coating effect is in this case the structured coating which is to be created on the carrier component.

In some embodiments, at least some of the masks have a thickness of at most 1 mm. Masks with a thickness of 1 mm have proved to be a good compromise to produce finer structures with the required accuracy. However, it is not necessary that all the masks have a thickness of at most 1 mm. Sections of the coating effect which, as seen in the propagation direction of the cold gas jet, have larger cross-sectional areas can also be produced with larger mask openings. In this case, larger mask thicknesses can also be realized so that method steps according to the invention can be saved overall. In these embodiments, the economical efficiency when using the method may increase.

In some embodiments, when using thicker masks, at least one of the masks is filled up in a plurality of steps. In this case, after the respective steps of depositing the material a removal process is carried out, in which process the deposited material located above the level of the upper side of the mask is removed. In this case, it may concern degrees of unevenness in the developing coating effects which already project beyond the plane of the upper side of the mask. Also, it may concern deposits of particles of the material in this case which have formed on the mask edges on the upper side of the mask. With increasing growth, these can have a negative influence on the forming of the coating effect which is why it can be advantageous to repeatedly remove these from time to time when the mask is being filled up.

The aforesaid deposits also form when using thin masks with openings of smaller width. As a result of the small thickness of the mask, their growth, however, does not have an effect during the filling up of mask openings of comparatively smaller depth. In some embodiments, it is therefore sufficient to remove these deposits after the total filling up of the mask opening with the material so that the subsequent mask can be laid upon a flat base which can be formed by the machined surface of the mask and of the deposited material.

In some embodiments, all the masks, the openings of which have widths of at most 1 mm at least in one direction, have a thickness of at most 1 mm. Alternatively, it can also be provided that in all the masks a ratio at most 1 is maintained between thickness of the mask and smallest width of the mask opening. In this case, design rules for the masks counteract the already mentioned forming of unfavorable flow conditions in the mask opening and an imperfect filling up of the mask opening with the material, which is associated therewith. There are the quality specifications of the coating effect to take into consideration. In concrete terms, the forming of pores in the coating effect which is to be formed must not exceed a value which is to be determined so that the coating effect satisfies the quality requirements of the individual case.

To test the suitability of a selected mask thickness in an application case, the permissible thickness of at least one of the masks is determined by the mask being completely filled up with the material which is to be machined. The coating effect which is formed from the deposited material is then subsequently tested as to whether a required quality is achieved. In this case the required quality may be specified by measurable parameters. As an example, the density of the coating effect can be used. This gives an indication of the proportion of pores in the coating effect. The pore size itself can also be tested since pores can be amassed especially in the wall region of the mask openings and/or can occur with greater volume. This can be checked for example by producing cuts.

For the tests, either samples or the coating effect itself can be produced. If the quality requirements in the coating effect are fulfilled, the test can be repeated with a mask of greater thickness. The test can in this respect contain a plurality of iteration steps. In some embodiments, the method can also be used to confirm the suitability of a selected mask thickness without possible clearance being exhausted by further iteration steps in the direction of greater mask thicknesses.

In some embodiments, the determined suitable thicknesses of the mask together with the process parameters of the coating are stored in a data bank. The determination of the mask thickness may be simplified in subsequent processes since recourse can be made to knowledge based on experience. This contains information about the geometry of the mask openings and about the mask thicknesses and also about the machined materials and coating parameters which are used in the cold gas dynamic spraying plant, such as powder feed rate, type of powder, gas temperature, gas pressure, and type of carrier gas used.

In some embodiments, at least one mask is constructed in a multiplicity of parts, wherein parting lines extend from the outer edge of the mask to the mask openings. These are arranged in such a way that the mask parts can be pulled apart parallel to their surface. This may allow the mask parts to be separated better from the coating effect. In particular, if the coating effect has undercuts, it is not possible, as stated above, to lift the masks from the carrier component in the upward direction. If, however, space at the sides of the coating effect is sufficient, the mask parts, at least in the case of small undercuts, can be drawn to the side so to speak and consequently be detached from the coating effect.

The removal of the masks in the upward direction or in parts to the side may allow them to be re-used for a subsequent execution of the method. Also, the removal of the masks within a short space of time is possible so that production time may be saved. If, however, a removal of the masks as a whole or in parts should not be possible, there is also the possibility of destroying these. If these for example are produced from a baser material than the coating effect, these can be chemically or electrochemically dissolved.

Various embodiments of the methods include producing the masks, wherein the thickness of the individual masks is determined in advance. They may include laying the first mask upon the carrier component and by cold gas dynamic spraying filling up with the material which is to be sprayed. Surplus material is then removed from the coating effect being created and from the upper side of the mask.

The next mask is then laid and filled up again by cold gas dynamic spraying. The thickness of the mask ensures that on the surface (of the carrier component or of the preceding deposit of material) left free by it, directly after the laying, a sprayed layer can be deposited up to the mask edges in a defect-free manner. After a repeated removal of surplus material, a check can be made as to whether the mask holes are completely filled up. In other words, the method may include determining whether the sprayed surface inside the mask opening after the removal aligns all over with the mask surface. This can be ensured by means of an automatic visual inspection process. If this is not the case, a further cold gas dynamic spraying and milling can be carried out before the next mask is laid. Only when the coating effect is satisfactory, e.g., all the mask holes are completely filled up, is the next mask laid if the structure is not yet finished. After the filling up of the last mask and removal of surplus material, the question of finishing the coating effect is affirmed.

FIG. 1 shows a first mask 12 has been laid upon a carrier component 11. This has a mask opening 13 which is filled up by a material 14. This is carried out by means of a cold gas dynamic spraying which is not shown in more detail. A convergent-divergent spray nozzle 15, which is part of the cold gas dynamic spraying plant, is shown in FIG. 1. By means of the spray nozzle 15, a particle jet 16 is directed onto the carrier component 11, wherein both the mask opening 13 and the surface 18 of the mask 12 on the edges of the mask opening 13 are provided with coating deposits of the material 14.

Figure 2:
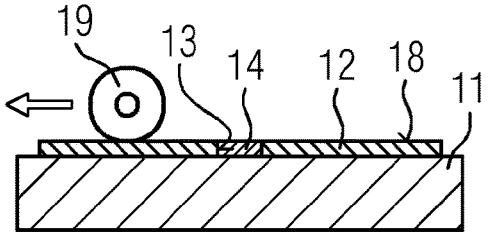

FIG. 2 shows an example method after the surplus material according to FIG. 1 has been removed by means of a milling head 19. For this purpose, the milling head 19 is moved over the surface 18 in the direction of the arrow, wherein it is also to be seen in FIG. 2 that the mask opening 13 is completely filled up with the material 14.

Figure 3:
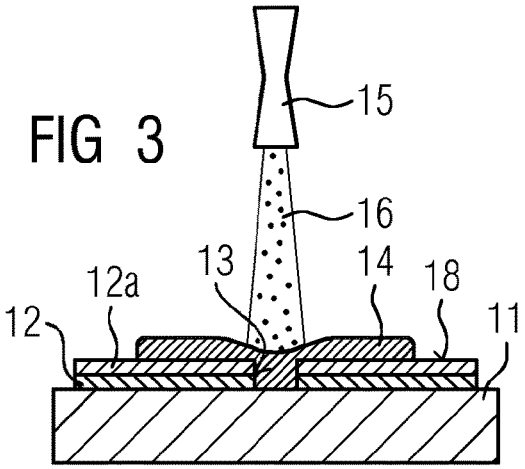

FIG. 3 shows additional process steps. An additional mask 12*a* is laid on top of the first mask 12, wherein the opening 13 of this mask 12*a* aligns accurately with that of the mask 12. By means of the spray nozzle 15, material is again deposited until the mask opening 13 is completely filled up again.

Figure 4:
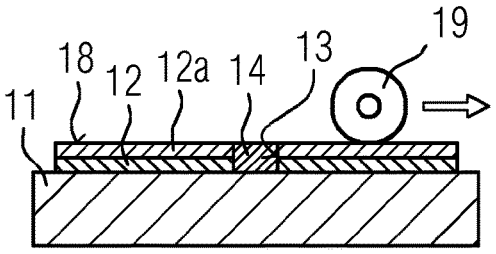

FIG. 4 shows an example method step in which the surplus material has again been removed by means of the milling head 19 (similar to the method step shown in FIG. 2).

Figure 5:
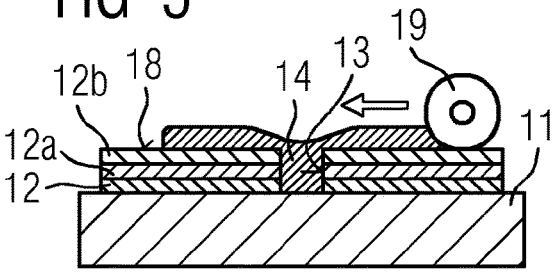

FIG. 5 shows an example method after two further steps, similar to FIG. 3, have been carried out. A mask 12*b* is first of all laid and this has been filled up with material 14 by means of the spray nozzle 15. The milling head 19 is now in the act of removing surplus material 14 from the surface 18 of the mask 12*b*. Also, the opening 13 of the additional mask 12*b* is congruent with the two preceding openings.

Figure 6:
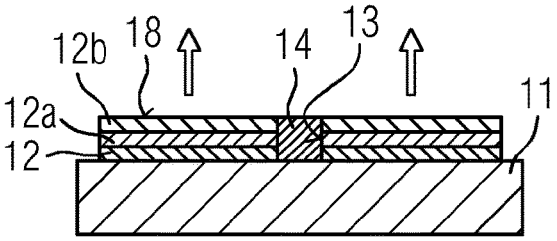

FIG. 6 shows an example method wherein the material 14 fills up all three mask openings 13. The component is now finished and the masks 12, 12*a*, 12*b* can be removed in the upward direction corresponding to the marked arrows. This is easily possible since the material 14 has a columnar structure with vertical sides (in the form of a prism).

Figure 7:
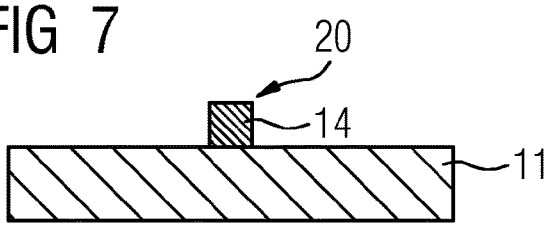
Figure 17:
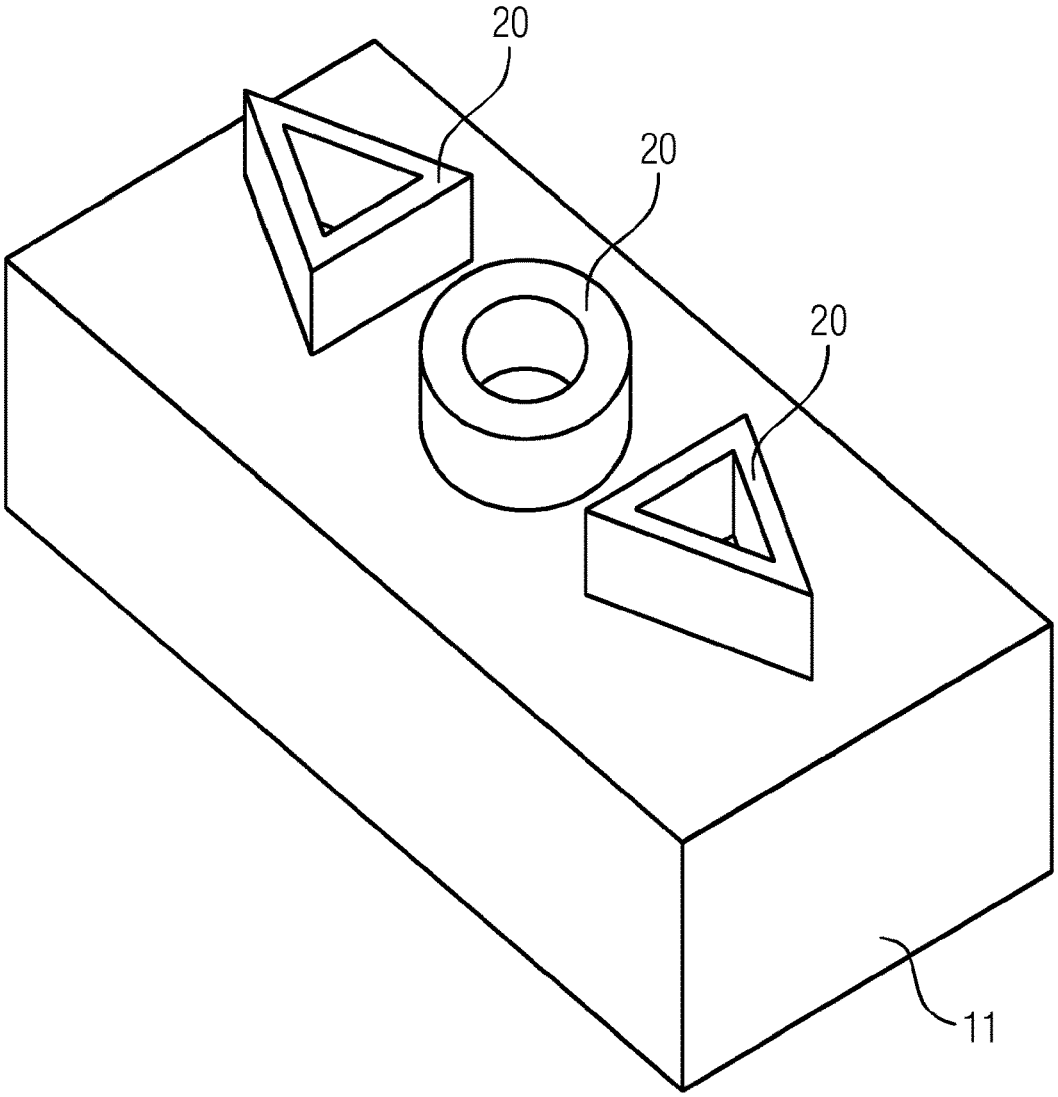
FIG. 17 shows in a three-dimensional view an exemplary embodiment of a possible component.

FIG. 7 illustrates that the material 14 remains as a coating 20 on the carrier component 11. The carrier component can now be transferred to its intended function. A possible carrier component is for example shown in FIG. 17. It could constitute a tool for stamping a symbol. The carrier component 11 in this case constitutes a surface on which the symbols to be stamped are constructed as a coating 20.

Figure 14:
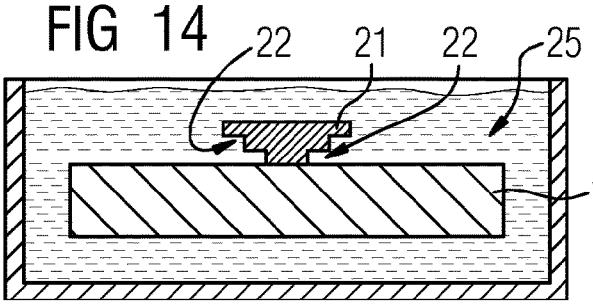
Figure 15:
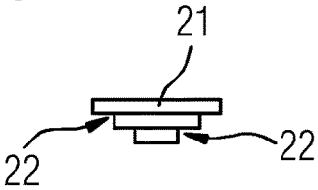

FIGS. 8 to 15 illustrate an example method in which the coating effect produces a component 21 (compare FIG. 15). The method proceeds basically like that according to FIGS. 1 to 7 and is explained below in more detail only with regard to its differences.

Figure 8:
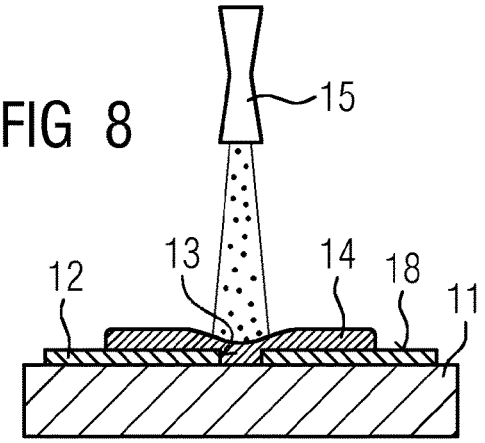
FIGS. 8 to 15 show in a schematically sectioned view selected method steps of another exemplary embodiment of the method according to teachings of the present disclosure for creating a component with undercuts.
Figure 9:
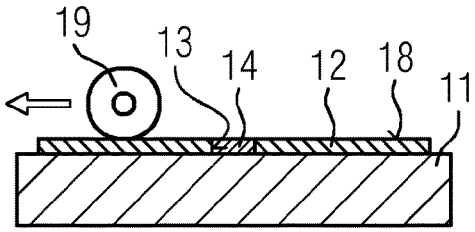
Figure 10:
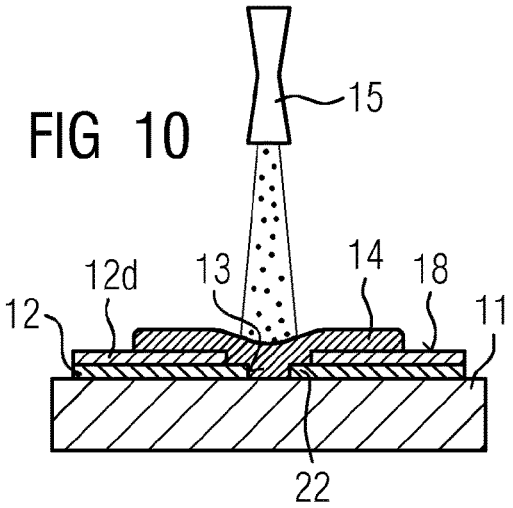
Figure 11:
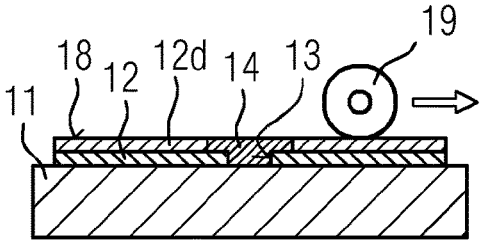

The method steps according to FIG. 8 and FIG. 9 proceed in a similar way to the method steps according to FIG. 1 and FIG. 2. As shown in FIG. 10, in contrast to FIG. 3, an additional mask 12*d* is laid, the mask opening 13 of which is larger than that of the mask 12. As a result of this, an undercut 22, which is to be seen better in FIGS. 14 and 15, is created in the material. The removal of the material according to FIG. 11 is carried out in a similar way to FIG. 4.

Figure 12:
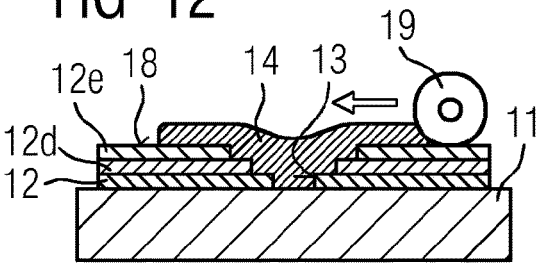
Figure 13:
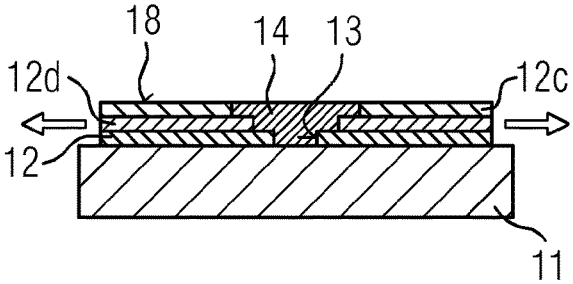

FIG. 12 differs from FIG. 5 because the additional mask 12*e* is designed with a larger opening 13 than the mask 12*d*. Overall, the coating effect consisting of the material 14, seen in FIG. 13, therefore has the shape of a mushroom. This makes removal of the masks 12, 12*d*, 12*e* difficult. If these have a parting line perpendicular to the plane of the drawing so that these are designed in two parts (compare FIG. 16), the respective mask halves according to FIG. 13 can be withdrawn in the direction of the two indicated arrows parallel to the surface of the carrier component 11.

However, the coating effect consisting of the material 14 can also have a geometry which does not enable a sideways withdrawal of the mask parts. In this case, it is shown in FIG. 14 how the masks 12, 12*a*, 12*b* can also be dissolved in an electrochemical bath 25, wherein the masks are no longer to be seen in FIG. 14 since these have already been dissolved. In a subsequent step, the thus created component 21 can be removed for example by wire-guided electrical discharge machining from the carrier component 11 which in the case of this method variant only serves a construction platform. The finished component 21 is shown as a side view in FIG. 15.

Figure 16:
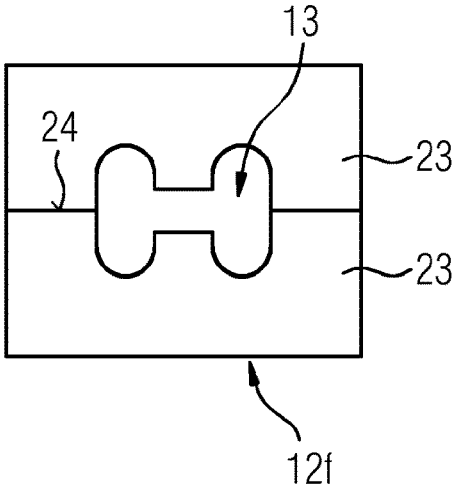
FIG. 16 shows the top view of a mask with parting line.

FIG. 16 shows a mask 12*f* constructed in two parts. This could serve for example for a method shown in FIG. 13. The mask 12*f* has two half-masks 23 which can be separated by means of a parting line 24. A component, produced in the mask opening 13, does not hamper removal of the mask even when overlying masks form undercuts in the component to be produced on account of larger or overlapping mask openings. A precondition, however, is that the undercuts are not excessively large (that is to say, the "undercut jumps" from mask to mask) when this leads to deposition of material on a mask forming the undercut. As a result of this, in particular an adherence of the mask on the coating effect occurs and has to be overcome by the withdrawal force of the mask.

What is claimed is:

1. A method for coating a carrier component with cold gas dynamic spraying, the method comprising:

laying a first mask with a first opening upon the carrier component;

depositing a material through the first opening of the first mask onto the carrier component;

after deposition of the material, removing any deposited material located above a level of an upper side of the first mask forming a flat surface in the region of the first opening even with the level of the upper side of the first mask;

determining whether the sprayed surface inside the first opening of the first mask aligns with the upper side of the first mask and, if not, depositing additional material through the first opening;

laying a second mask with a second opening on the upper side of the first mask;

depositing the material upon the material previously deposited;

after deposition of the material through the second mask, removing any deposited material located above a level of the upper side of the second mask forming a flat surface in the region of the second opening even with the level of the upper side of the second mask;

determining whether the sprayed surface inside the second opening of the second mask aligns with the upper side of the second mask and, if not, depositing additional material through the second opening;

repeating layers of additional masks and material deposition until the deposited material reaches a required thickness on the carrier component; and after the deposited material reaches the required thickness, removing the masks and leaving a coating in place;

wherein at least one of the masks comprises a multiplicity of parts, and parting lines extend from an outer edge of the mask to the respective mask opening so that the multiplicity of parts can be pulled apart in a direction parallel to their upper side and reused in later material deposition processes.

2. The method as claimed in claim 1, further comprising separating the coating from the carrier component.

3. The method as claimed in claim 1, wherein at least some of the masks have a thickness of at most 1 mm.

4. The method as claimed in claim 3, wherein:

the openings of each mask have widths of at most 1 mm at least in one direction; and each of the masks has a thickness of at most 1 mm.

5. The method as claimed in claim 1, wherein each of the masks has a ratio of at most 1 between thickness of the mask and smallest width of the mask opening.

6. The method as claimed in claim 1, wherein consecutive masks have congruent openings.

7. The method as claimed in claim 1, wherein at least one of the masks is filled up in more than one deposition step, and, after the respective steps of depositing the material any deposited material located above the level of the upper side of the respective mask is removed.

8. The method as claimed in claim 1, wherein a thickness of at least one of the masks corresponds to the deposition process used to completely fill up the respective opening with the material; and further comprising subsequently testing the coating formed in comparison to a required quality.

9. The method as claimed in claim 8, wherein the determined, suitable thickness of the masks together with testing parameters of the coating are stored in a data bank.

10. The method as claimed in claim 1, wherein a shape of the mask openings, including a mask thickness, depends at least in part on geometry of the component broken down by computer calculation into disks lying one on top of the other.

11. The method as claimed in claim 1, wherein consecutive masks have openings which lie completely one on top of the other and reduce in size as the additional masks are added.

* * * * *